US007275808B2

(12) United States Patent
Katsuyama et al.

(10) Patent No.: US 7,275,808 B2
(45) Date of Patent: Oct. 2, 2007

(54) INK CARTRIDGE AND INK JET PRINTER

(75) Inventors: Goro Katsuyama, Kanagawa (JP); Masaaki Kabumoto, Chiba (JP); Kanae Amemiya, Tokyo (JP); Osamu Miki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 267 days.

(21) Appl. No.: 10/523,415

(22) PCT Filed: Sep. 8, 2003

(86) PCT No.: PCT/JP03/11447

§ 371 (c)(1),
(2), (4) Date: Feb. 3, 2005

(87) PCT Pub. No.: WO2004/026583

PCT Pub. Date: Apr. 1, 2004

(65) Prior Publication Data

US 2005/0270345 A1 Dec. 8, 2005

(30) Foreign Application Priority Data

Sep. 19, 2002 (JP) ..... 2002-273520

(51) Int. Cl.
*B41J 2/14* (2006.01)
*B41J 2/175* (2006.01)

(52) U.S. Cl. ..... 347/49; 347/86

(58) Field of Classification Search ..... 347/49, 347/86, 87

See application file for complete search history.

(56) References Cited

U.S. PATENT DOCUMENTS 5,519,422 A * 5/1996 Thoman et al. ..... 347/49
5,530,531 A * 6/1996 Girard ..... 399/120
5,880,764 A * 3/1999 Barinaga ..... 347/86
5,956,057 A * 9/1999 Childers et al. ..... 347/49
6,082,852 A 7/2000 Soga et al.
6,097,405 A 8/2000 Lo et al.
6,123,421 A 9/2000 Bartolome et al.

(Continued)

FOREIGN PATENT DOCUMENTS

EP 0-829-363 A2 3/1996

(Continued)

OTHER PUBLICATIONS

U.S. Appl. No. 10/523,415, filed Feb. 3, 2005, Katsuyama et al.

(Continued)

*Primary Examiner*—Anh T. N. Vo
(74) *Attorney, Agent, or Firm*—Oblon, Spivak, McClelland, Maier & Neustadt, P.C.

(57) ABSTRACT

A notch (recess portion) is proved on a front face of an ink cartridge, and a holding portion is set between a corner portion of the recess portion and a projection portion provided on a cartridge upper face. A cartridge can be held securely by nipping the cartridge between two fingers at both ends thereof (the projection portion and the corner portion) of the holding portion, even if the cartridge is a thin type cartridge, so that attaching/detaching of the cartridge to a printer main unit can be performed easily and securely.

22 Claims, 9 Drawing Sheets

U.S. PATENT DOCUMENTS 6,290,346 B1 * 9/2001 Santhanam et al. ..... 347/86

FOREIGN PATENT DOCUMENTS

| | | |
|---|---|---|
| EP | 0-930-170 A2 | 7/1999 |
| JP | 60-032671 | 2/1985 |
| JP | 04-347653 | 12/1992 |
| JP | 09-118019 | 5/1997 |
| JP | 10-202900 | 8/1998 |
| JP | 10-305591 | 11/1998 |
| JP | 11-170557 | 6/1999 |

OTHER PUBLICATIONS

U.S. Appl. No. 11/113,174, filed Apr. 25, 2005, Katsuyama et al.

* cited by examiner

INK CARTRIDGE AND INK JET PRINTER

TECHNICAL FIELD

The present invention relates to an ink cartridge and an ink jet printer, and more particularly to an ink cartridge whose operability or setting reliability during attaching/detaching to a printer can be improved even if the ink cartridge is of a narrow and thin type, and an ink jet printer.

BACKGROUND ART

Conventionally, an ink jet printer that jets fine ink droplets from nozzles to such a recording medium as a sheet to perform recording is well known. Such an apparatus is described in, for example, Japanese Patent Application Laid-Open Nos. H10-305591 and H10-202900. An ordinary ink jet printer is provided with a printing head that has nozzles and an ink cartridge(s) for supplying ink(s) to the printing head. Many types of an apparatus that is mainly provided for personal use, include an ink cartridge mounted on a carriage together with a head. On the other hand, many types of an apparatus for business use are constituted so as to mount an ink cartridge and a head (and a carriage) on an apparatus main unit independently of each other. In the apparatuses of both the types, when ink within a cartridge is consumed, the cartridge is detached from a cartridge mounting portion and is replaced with a new one. Some types of the apparatus for personal use have an ink cartridge and a head integrated with each other and the cartridge is replaced together with the head when the ink is consumed.

As reference literatures of an ink cartridge used in such an ink jet printer, there are disclosures in Japanese Patent Application Laid-Open Nos. S60-32671 and H4-347653.

In the types for business use, a capacity of an ink cartridge is larger than that for personal use. Recently, especially, the ink cartridge capacity is increasing so as to meet increase in ink consumption due to speeding-up of printings.

In the ink jet printer, however, since a carriage on which a head is mounted, conducts recording while moving above a sheet leftward and rightward (in a widthwise direction of a sheet), it is necessary to provide a space which allows movement of the carriage therein above a sheet threading region. Accordingly, in a type that an ink cartridge is mounted on an apparatus main unit, since it is difficult to receive an ink cartridge within a widthwise size of a sheet threading (because the height of the apparatus is increased), the ink cartridge is mounted outside the sheet threading width. In the apparatuses described in the Japanese Patent Application Laid-Open Nos. H10-305591 and H10-202900, an ink cartridge is disposed outside the sheet threading width.

However, when an ink cartridge is disposed outside a sheet threading width, the apparatus width increases. Recently, the term "ink jet printer" ordinarily indicates "a color printer", whose apparatus width is increased due to mounting of (four or more) ink cartridges for four or more colors or increase in capacity of each cartridge.

In order to solve the problem about increase in apparatus width, thinning of a cartridge is proposed. When a plurality of thin type ink cartridges are arranged side by side, unless a large interval is secured between adjacent cartridges, it is difficult to attach/detach (especially, detach) each cartridge. However, when the interval is too large, such a problem arises that the apparatus width increases.

In order to facilitate taking-out of a thin type cartridge, it is considered to adopt a so-called pop-up mechanism in which a cartridge is moved to a taking-out position allowing easy grasping thereof by a lever operation, a notch portion pushing, or the like. However, the mechanism causes such a problem as complication of a structure thereof, increase in weight and size, and increase in cost.

Even in one cartridge, the cartridge is increased in a vertical or (and) a front and rear (depth direction) size corresponding to a thinned amount thereof, so that there is also a problem that it is difficult to handle (grasp or hold) such a cartridge by those with small hands.

In an apparatus where attaching/detaching of a cartridge is performed in a horizontal direction (in a front and rear direction of the apparatus), there is a problem that, when an installation place for the apparatus is low, it is difficult to attach/detach the cartridge. Alternatively, in an apparatus where attaching/detaching of a cartridge is performed in a vertical direction, there is a problem that, when an installation place of the apparatus is high, it is difficult to attach/detach the cartridge. Attachability/detachability of a cartridge is also related to thinning of the cartridge. For example, when holding style of the cartridge is restricted due to thinning thereof, the attachability/detachability of the cartridge in a horizontal direction or in a vertical direction may deteriorate due to the holding style of the cartridge.

The present invention has been achieved in view of the above circumstances, and it is an object of the present invention to solve the above problems in the ink jet printer and the ink cartridge therefor, and to provide an ink cartridge that is easily handled and easily attached to/detached from an apparatus without enlarging the apparatus width.

DISCLOSURE OF THE INVENTION

The ink cartridge according to an aspect of the present invention can be attached to/detached from an ink jet printer, and is provided with a holding portion formed over two faces of the cartridge adjacent to each other.

According to the present aspect, since the holding portion formed over two faces of the cartridge adjacent to each other is provided, even if the cartridge is of a thin type, the cartridge can be held securely, so that attaching/detaching to the printer main body can be performed easily and securely.

In the ink cartridge according to another aspect of the present invention, the holding portion has a structure held from a vertical direction.

According to the present aspect, since the holding portion is formed to be held from a vertical direction, a holding style corresponding to a thin type cartridge is possible. Attaching/detaching operation is facilitated regardless of an attaching/detaching direction.

In the ink cartridge according to still another aspect of the present invention, the two faces of the cartridge adjacent to each other are an upper face and a front face of the cartridge.

According to the present aspect, since the two faces of the cartridge adjacent to each other are an upper face and a front face of the cartridge, attaching/detaching can be conducted easily owing to the holding portion extending over the upper face and the front face.

In the ink cartridge according to still another aspect of the present invention, one end of the holding portion is a projection portion provided on an upper face of the cartridge.

According to the present aspect, since one-end of the holding portion is the projection portion provided on an upper face of the cartridge, the user's finger can be put easily, so that the cartridge can be held easily and securely.

In the ink cartridge according to still another aspect of the present invention, the projection portion is provided at a front end portion of the upper face of the cartridge.

According to the present aspect, since the projection portion is provided on the front end portion of the cartridge upper face, the cartridge in an attached state can be held easily. Even during attaching/detaching operation of the cartridge, the finger is hard to come in contact with another cartridge or the printer main unit, and attaching/detaching operation can be facilitated.

In the ink cartridge according to still another aspect of the present invention, one end of the holding portion is a corner portion of a recess portion provided on a front face of the cartridge.

According to the present aspect, since one end of the holding portion is the corner portion of the recess portion provided on the front face of the cartridge, a portion of the cartridge on which the finger should be put can be recognized easily, and the cartridge can be held easily.

In the ink cartridge according to still another aspect of the present invention, the corner portion of the recess portion is formed to have an acute angle.

According to the present aspect, since the corner portion of the recess portion is formed to have an acute angle, the user's finger is hard to slip thereon, so that the cartridge can be held securely.

In the ink cartridge according to still another aspect of the present invention, the corner portion of the recess portion is positioned in a midway, in a vertical direction, of the front face of the cartridge.

According to the present aspect, since the corner portion of the recess portion is positioned in a midway, in a vertical direction, of the front face of the cartridge, even if the cartridge has a size large in a vertical direction, the cartridge can be held easily. Accordingly, the cartridge can be held easily and securely even with a small hand.

In the ink cartridge according to still another aspect of the present invention, the recess portion is formed over an entire width of the cartridge and is opened at both end portions.

According to the present aspect, since the recess portion is formed over the entire width of the cartridge and it is opened at both the end portions, the user can put the finger on the recess portion with the finger projecting from the recess portion, which facilitates putting the finger thereon. Recess portions of cartridges arranged side by side can be used for respective cartridges, so that taking-out of a thin type cartridge can be facilitated.

In the ink cartridge according to still another aspect of the present invention, an angle formed by a lower end portion of the recess portion and the front face of the cartridge is an obtuse angle.

According to the present aspect, since the angle formed by the lower end portion of the recess portion and the cartridge front face is an obtuse angle, the introducing portion of the finger to the recess portion can be formed, and a finger putting operation of the user can be facilitated.

In the ink cartridge according to still another aspect of the present invention, the holding portion has a flat portion that allows pressing in a cartridge mounting direction.

According to the present aspect, since the holding portion has a flat portion which can be pressed in a cartridge mounting direction, the cartridge can be attached securely and easily by pushing the holding portion.

In the ink cartridge according to still another aspect of the present invention, a holding style of the holding portion can be changed according to a height at a time of cartridge mounting.

According to the present aspect, since holding style of the holding portion can be changed according to a height at a time of cartridge mounting, attaching/detaching of the cartridge can be conducted easily regardless of an installation place of a printer.

The ink cartridge according to still another aspect of the present invention has a guide member that guides the cartridge during cartridge mounting.

According to the present aspect, since the guide member is provided for guidance during cartridge mounting, a cartridge mounting operation to the printer main unit can be facilitated.

In the ink cartridge according to still another aspect of the present invention, positioning of the cartridge during cartridge mounting is performed by the guide member.

According to the present aspect, since positioning at a time of cartridge mounting is performed by the guide member, ink can be supplied securely.

In the ink cartridge according to still another aspect of the present invention, the guide member has a positioning portion that performs positioning in a vertical direction.

According to the present aspect, since the guide member has the positioning portion applied for positioning in a vertical direction, positioning of the ink cartridge in the vertical direction can be conducted securely.

In the ink cartridge according to still another aspect of the present invention, the guide member has a positioning portion that performs positioning in a front and rear direction.

According to the present aspect, since the guide member has the positioning portion applied for positioning in front and rear directions, positioning of the ink cartridge in the front and rear directions can be conducted securely.

In the ink cartridge according to still another aspect of the present invention, the guide member is provided at a different position corresponding to the color of ink to be accommodated.

According to the present aspect, since the guide members are provided at different positions corresponding to colors of inks to be accommodated, attaching of an erroneous color ink cartridge is prevented.

In the ink cartridge according to still another aspect of the present invention, an ink supplying tube is provided at a rear face portion of the cartridge, a space is provided around the ink supplying tube, and the space is opened to the outside at both sides, in a widthwise direction, of the cartridge.

According to the present aspect, since the ink supplying tube is provided at the cartridge rear face portion, the space is provided around the ink supplying tube, and the space is opened to the outside at the both sides, in the widthwise direction, of the cartridge, the protective member that protects the ink supplying needle in the printer main unit can be escaped even in a thin type cartridge.

The ink cartridge according to still another aspect of the present invention is attachable to/detachable from an ink jet printer, and a recess portion is provided at a front face of the cartridge.

According to the present aspect, since the recess portion is provided at the cartridge front face, the finger putting portion can be provided at the cartridge front face, so that the ink cartridge can be held utilizing the finger putting portion.

In the ink cartridge according to still another aspect of the present invention, one corner portion at the recess portion is a finger putting portion on which a finger of the user is put during cartridge attaching/detaching.

According to the present aspect, since one corner portion of the recess portion is the finger putting portion on which a finger is put during cartridge attaching/detaching, a portion of the ink cartridge on which the finger should be put can be recognized easily, so that the user can grasps the cartridge easily.

In the ink cartridge according to still another aspect of the present invention, the finger putting potion is formed to have an acute angle.

According to the present aspect, since the finger putting portion is formed to have an acute angle, the finger of the user is hard to slip thereon, and the cartridge can be held securely.

In the ink cartridge according to still another aspect of the present invention, the recess portion is positioned in a midway, in a vertical direction, of the front face of the cartridge.

According to the present aspect, since the recess portion is positioned in a midway, in a vertical direction, of the front face of the cartridge, even if the cartridge has a size large in a vertical direction, the cartridge can be held easily. Accordingly, even if the user has a small hand, the cartridge can be held easily and securely.

In the ink cartridge according to still another aspect of the present invention, the recess portion is formed over an entire width of the cartridge and is opened at both end portions.

According to the present aspect, since the recess portion is formed over an entire width of the cartridge and it is opened at both the end portions, the user can put the finger on the recess portion with the finger projecting from the recess portion, which facilitates putting of the finger thereon. Recess portions of cartridges arranged side by side can be used for respective cartridges, so that taking-out of a thin type cartridge can be facilitated.

In the ink cartridge according to still another aspect of the present invention, an angle formed by a lower end portion of the recess portion and the front face of the cartridge is an obtuse angle.

According to the present aspect, since the angle formed by the lower end of the recess portion and the cartridge front face is an obtuse angle, the introducing portion of the finger to the recess portion can be formed, and a finger putting operation of the user can be facilitated.

The ink jet printer according to still another aspect of the present invention is provided with the ink cartridge described in any one of the above aspects.

According to the present aspect, by providing the ink cartridge described in any one of the above aspects, an ink jet printer to which an ink cartridge can be attached/detached easily and securely, even if the cartridge is thin can be provided.

The ink jet printer according to still another aspect of the present invention is a color printer that can be mounted with a plurality of the ink cartridges outside a sheet threading width independently of a printing head.

According to the present aspect, even in a color printer where a plurality of ink cartridges are mounted outside a sheet threading width independently of a printing head, a mounting width for the ink cartridges can be suppressed considerably.

The ink jet printer according to still another aspect of the present invention is a color printer that can be mounted with a plurality of the ink cartridges together with a printing head in a carriage.

According to the present aspect, even in a color printer where a plurality of ink cartridges are mounted on a carriage together with a printing head, a thin type ink cartridge can be attached/detached easily and securely.

In the ink jet printer according to still another aspect of the present invention, an attaching/detaching direction of the ink cartridge is horizontal.

According to the present aspect, even when an attaching/detaching direction of an ink cartridge is horizontal, a thin type ink cartridge can be attached/detached easily and securely.

In the ink jet printer according to still another aspect of the present invention, an attaching/detaching direction of the ink cartridge is vertical.

According to the present aspect, even when an attaching/detaching direction of an ink cartridge is vertical, a thin type ink cartridge can be attached/detached easily and securely.

In the ink jet printer according to still another aspect of the present invention, the holding member that holds the ink cartridge is positioned such that an upper member thereof is retreated nearer to a depth side of the apparatus as compared with a lower member thereof.

According to the present aspect, since the holding member that holds the ink cartridge is positioned such that the upper side member is retreated nearer to the apparatus depth side as compared with the lower side member, the degree of freedom in the cartridge attaching/detaching direction is increased so that an attaching/detaching operation is facilitated.

BEST MODE FOR CARRYING OUT THE INVENTION

The present invention will be explained in detail with reference to the accompanying drawings.

Figure 1:
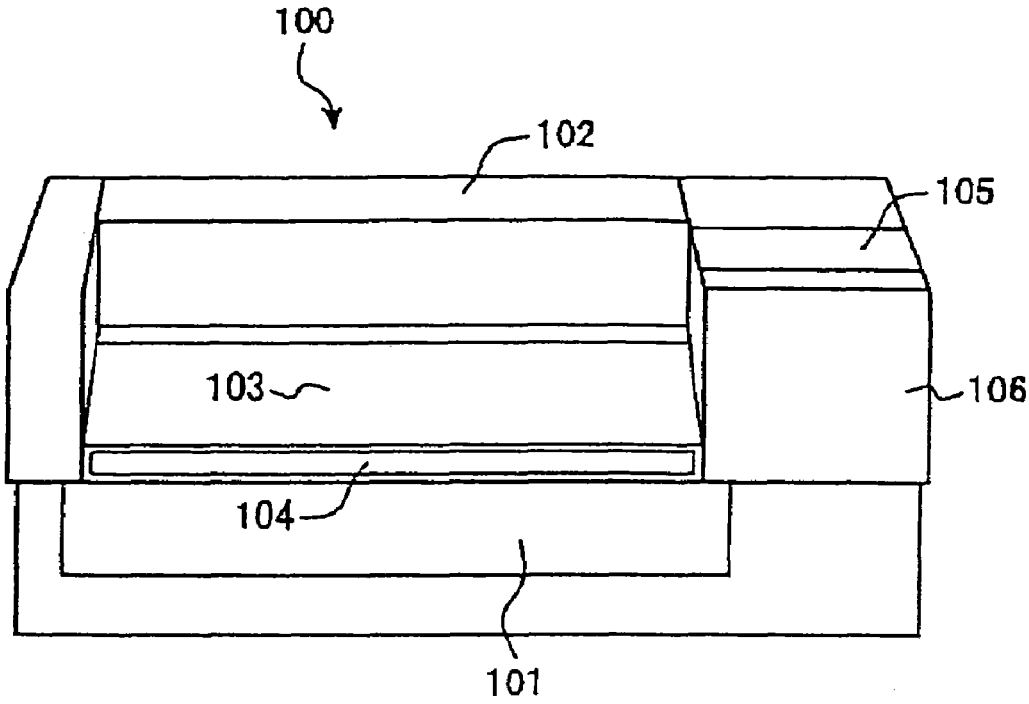
FIG. 1 is a front view of one example of an ink jet printer on which an ink cartridge according to the present invention is mounted.

FIG. 1 is a front view of one example of an ink jet printer on which an ink cartridge according to the present invention is mounted.

Figure 2:
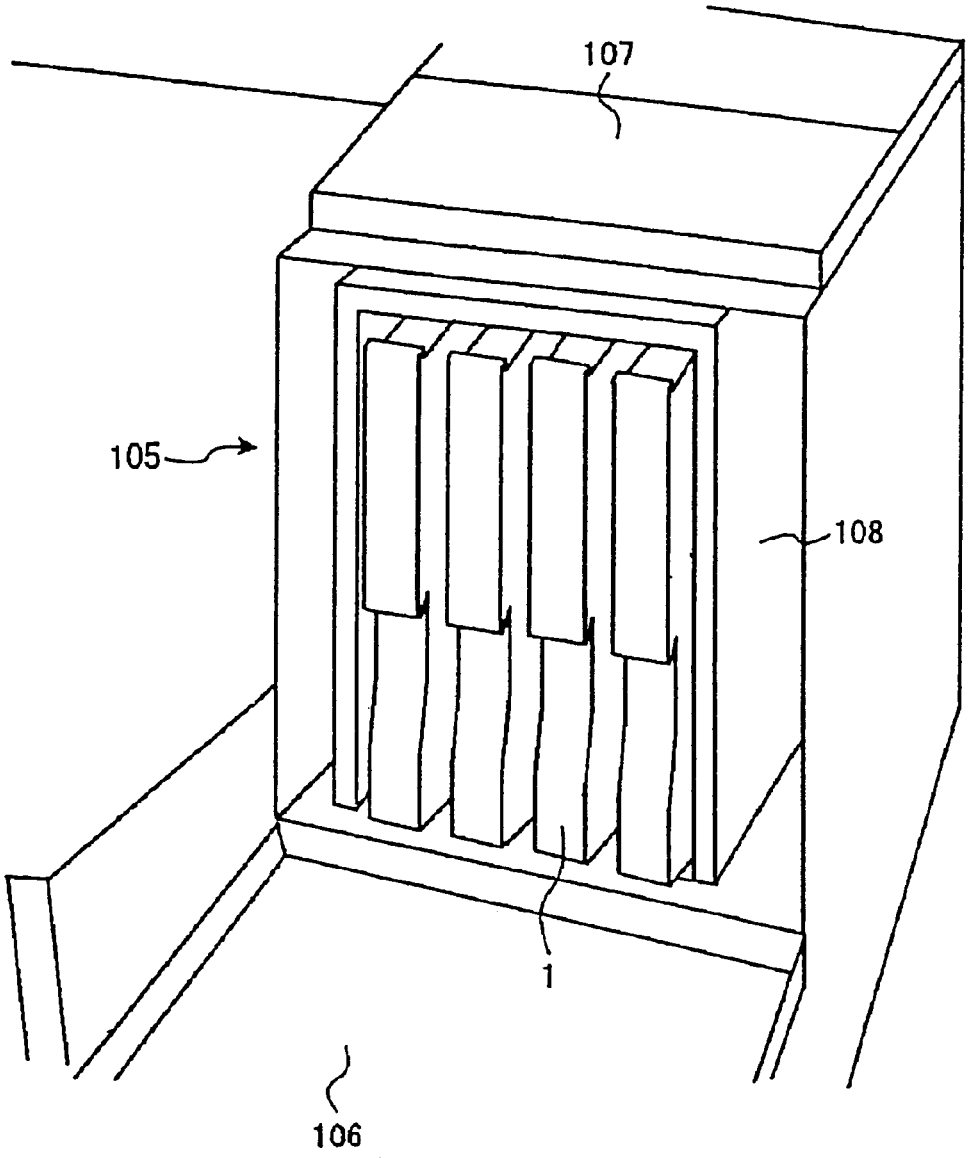
FIG. 2 is a perspective view of an ink cartridge mounting portion in the printer.

An ink jet printer 100 shown in FIG. 1 includes a sheet cassette 101 that accommodates media to be recorded, such as sheets, a carriage moving portion 102 on which a carriage (not shown) that carries a printing head reciprocates in a widthwise direction of a sheet for performing printing, a sheet discharging unit 103 to which a printed sheet is discharged, a discharged sheet tray 104 that can be drawn out in a front side of an apparatus, and the like. A cartridge mounting portion 105 on which an ink cartridge described later is mounted is provided on the right side of a printer main unit. As shown in FIG. 2, the cartridge mounting portion 105 can be accessed thereto by opening a cover 106. An upper face of the cartridge mounting portion 105 is constituted as an operation portion 107.

Since a constitution of a printing unit in this printer is similar to that of a well-known ink jet system, the ink cartridge will be mainly explained.

FIG. 2 depicts a state that the cover 106 of the cartridge mounting portion 105 has been opened, and four ink cartridges 1 (of four colors) are arranged side by side. This example depicts cartridges for black (Bk), cyan (C), magenta (M), and yellow (Y) arranged in the order from the left. Each cartridge can be mounted at a predetermined position by a guide portion (not shown) of a set member 108 provided on the printer main unit.

Figure 3A:
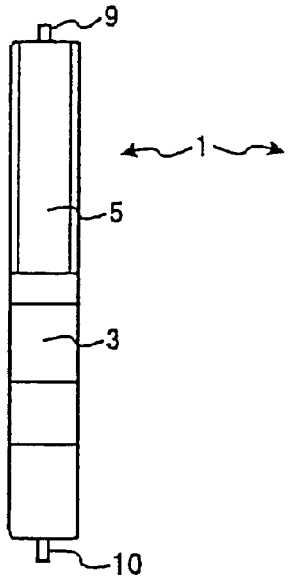
FIGS. 3A, 3B 3C, and 3D are a front view, a side view, a perspective view, and a partial view of one example of the ink cartridge according to the present invention.
Figure 3B:
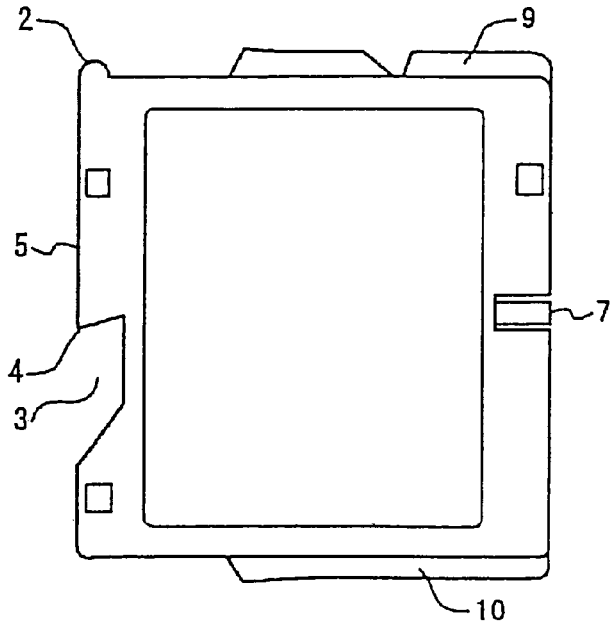
Figure 3D:
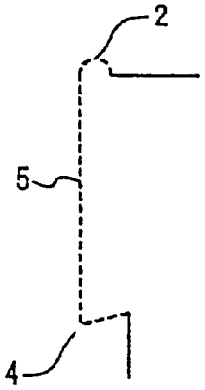
Figure 3C:
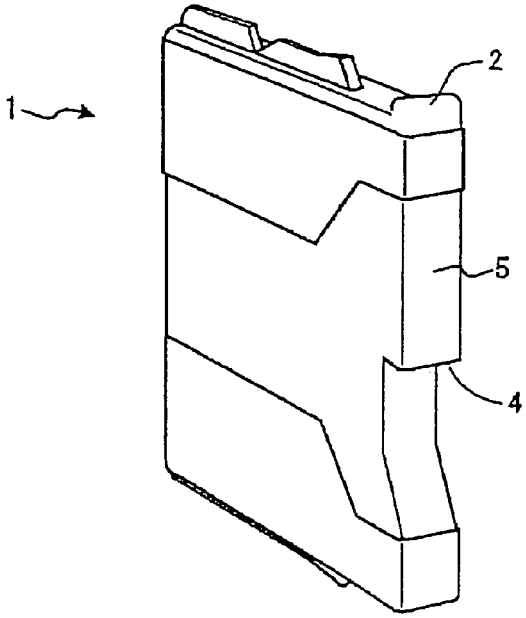

FIGS. 3A to 3D depict an appearance of the cartridge 1, FIG. 3A being a front view, FIG. 3B being a side view, FIG. 3C being a perspective view, and FIG. 3D being a partial detailed view. As shown in FIGS. 3A to 3D, the cartridge 1 is fundamentally formed in a rectangular parallelepiped shape and has substantially a square shape when seen from a side thereof, as shown in FIG. 3B. As shown in FIG. 3A which is a view of the cartridge 1 as seen from the front thereof, the cartridge 1 has a considerably large height size as compared with a width size thereof, and is formed in a thinned type.

On the front side of a cartridge upper face, that is, on the left end portion of an upper face in FIG. 3B, a projection portion 2 with a rounded corner is formed. The projection portion 2 constitutes a first finger putting portion on which a finger of a user is put when the cartridge 1 is held. A notch portion 3 is formed on a portion of the front side face of the cartridge which is positioned slightly below the center thereof in a shape recessed from a cartridge side face toward the inside of the cartridge. A corner portion 4 on the front upper end portion of the notch portion 3 serves as a second finger putting portion to which a finger of the user is put when the cartridge 1 is held. A portion extending from the projection portion 2 to an inside end portion of the corner portion 4, namely, a portion indicated with a dotted line in FIG. 3D constitutes a holding portion 5 for holding the cartridge 1.

Figure 4:
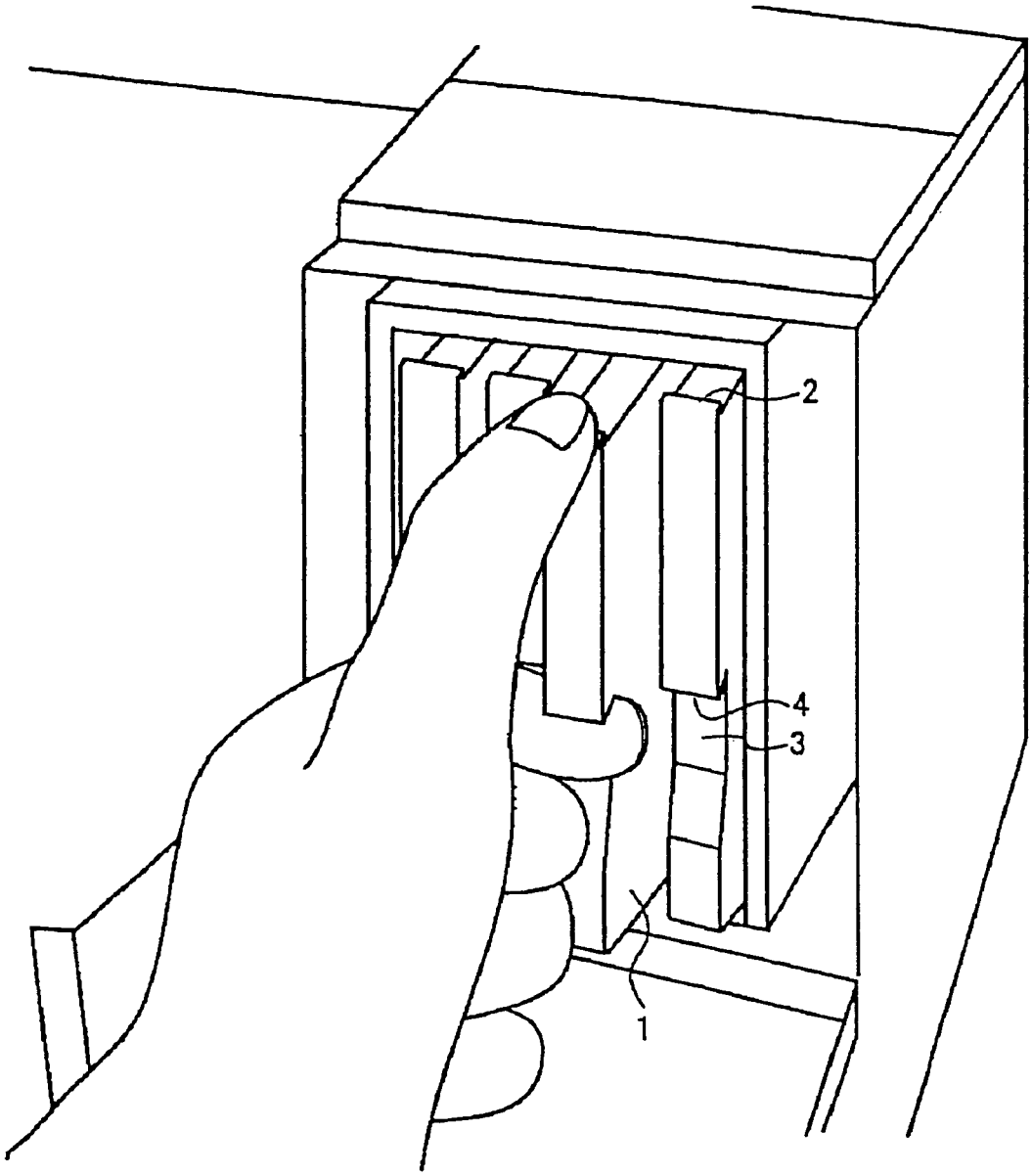
FIG. 4 is a perspective view of a state of attaching/detaching an ink cartridge to/from the cartridge mounting portion shown in FIG. 2.

That is, when the ink cartridge 1 of the embodiment is attached to/detached from the cartridge mounting portion 105, as shown in FIG. 4, the user puts the thumb on the projection portion 2 at the upper face front end portion of the cartridge, inserts the forefinger into the notch portion 3 on the front face of the cartridge to put it to the corner portion 4, and supports the cartridge so as to nip the holding portion 5 between the two fingers. FIG. 4 depicts the left hand of the user, but the attaching/detaching operation may also be conducted similarly with the right hand, where the user nips and holds the holding portion 5 between the thumb and the forefinger. When demounting the cartridge, the user draws the cartridge to his/her side, and when mounting the cartridge, pushes the cartridge toward the depth side of the apparatus. The size of the holding portion 5 (a vertical size) is set to a distance obtained when a standard size adult expands the thumb and forefinger lightly.

This style of holding (supporting method) the cartridge in which the user puts the thumb on the projection portion 2 at the cartridge upper face front end portion and puts the forefinger on the corner portion 4 at the notch portion 3 positioned on a middle portion of the cartridge front face, is designed to improve operability when a person with an average height moves the ink carriage 1 forward and rearward (toward the front side and the depth side of the apparatus) in a standing posture in a state of the ink jet printer 100 placed on a desk.

This supporting method facilitates the demounting operation of the cartridge such that the user can first pull the ink cartridge 1 to his/her side to draw the cartridge out of the mounting portion 105 (the set member 108) and then raise the ink cartridge obliquely upward, which operation is very easy. In view of a human body structure, when the user moves his/her elbow backward (which is a movement for demounting the cartridge 1) from a state that the thumb and the forefinger are respectively positioned on an upper side and a lower-side (a state that the user nips the holding portion 5 between two fingers), the elbow naturally moves obliquely upwardly to gradually fold. Therefore, the user's hand rises slightly upwardly while moving to approach to his/her own body.

Since the ink cartridge 1 in the embodiment has such a configuration that the projection portion 2 which is the finger putting portion is provided on the cartridge upper face, the notch portion 3 is formed in the middle portion of the front face thereof, and the corner portion 4 which is the second finger putting portion is provided on the user's side upper end portion (of the notch portion), a human natural movement leads to an action for demounting the cartridge 1.

Similarly, in a setting operation of the cartridge 1 in the mounting portion 105, when the user stands before the printer 100, he/she will be looking down the cartridge mounting portion 105 from an obliquely upper side at the user's side of the apparatus. Therefore, when the user stretches the elbow so as to extend the hand holding a spare cartridge toward the depth side of the apparatus, the hand and the cartridge naturally moves forward (at that time, moves slightly downward). Accordingly, a human natural movement leads to an action for mounting the cartridge 1.

Instead of installing the ink jet printer 100 on the desk, it may be installed on a place slightly higher than the desk, for example, on a shelf or the like. In such a case, an attaching/detaching operation of the ink cartridge 1 can be conducted easily by changing the holdings style of the ink cartridge 1.

When the installation place for the ink jet printer 100 is high, the user puts the forefinger on the projection portion 2 of the cartridge upper face front end, puts the thickest part of the thumb on the corner portion 4 of the notch portion 3 in the middle portion of the cartridge front face, and nips the holding portion 5 between the two fingers. When the cartridge is demounted, the user pulls the cartridge to the user's side, and when the cartridge is mounted, the user pushes the cartridge toward the depth side.

The style of holding the holding portion 5 by putting the forefinger on the projection portion 2 and putting the thickest part of the thumb on the corner portion 4 facilitates an attaching/detaching operation of the cartridge when the installation place of the printer is high. In view of a human body structure, it is extremely easy for the user to raise or lower his/her hand, and to move the hand forward and rearward or leftward and rightward from a state that the forefinger and the thumb are positioned on an upper side and a lower side (while nipping the holding portion 5 between two fingers).

Accordingly, when the cartridge 1 is demounted from the printer which is installed on a high place, the user may just put the forefinger on the projection portion 2 and put the thickest part of the thumb on the corner portion 4 to nip the holding portion 5 between the two fingers, and pull the cartridge toward his/her side and lower the hand. When the user mounts the cartridge 1 to the printer, he/she just puts the forefinger on the projection portion 2 of a spare cartridge and puts the thickest part of the thumb on the corner portion 4 to nip the holding portion 5 between the two fingers and raises the hand to push the spare cartridge into the depth side of the mounting portion 105. The mounting and the demounting work can be conducted according to a human natural movement.

The ink cartridge 1 according to the embodiment has such an aspect that attaching/detaching of a cartridge can be conducted according to a natural action due to formation of the holding portion 5 extending over two faces (the upper and the front faces in this embodiment) of the cartridge adjacent to each other, which can be considered as a shape facilitating attaching/detaching operation in view of human engineering or human mechatronics.

Especially, an aspect that the holding portion 5 is provided to extend over two faces of the cartridge adjacent to each other and the cartridge can be held by nipping the holding portion 5 between two fingers from top and bottom allows secure holding of the cartridge even if the cartridge is thin and facilitates attaching/detaching operation.

The conventional ink cartridge is constituted so as to be nipped between two fingers of the user from left and right (from a thickness direction of the cartridge) or be held between two fingers from front and rear (the front face and the rear face) or from top and bottom (an upper face and a lower face) thereof. When two opposed faces of a cartridge is held, according to thinning of the cartridge, the user feels unstable when holding the cartridge, which instead results in difficulty in holding the cartridge. Further, when the user holds the cartridge from the front and rear or from the top and bottom, it becomes difficult for the user to hold the cartridge according to large-sizing of the cartridge (especially, for a person with a small hand). Furthermore, when the cartridge is nipped from left and right sides thereof, when a space between the adjacent cartridges is small, the user can not nip the cartridge, which results in increase in apparatus width in a color printer with a plurality of cartridges. In the cartridge 1 of the embodiment, however, since thinning of a cartridge can be achieved without sacrificing easiness of attaching/detaching operation, it is unnecessary to increase the apparatus width even in the color printer.

Since the holding portion 5 is provided on the two faces of the cartridge adjacent to each other, the user can know, at a glance, a portion on which he/she should put the fingers to hold the cartridge at an attaching/detaching time of the cartridge, which also facilitates an attaching/detaching operation visually. For example, in the conventional ink cartridge, there is such a holding way that the user nips the left side face and the right side face of the cartridge or nips the cartridge from the upper face and the bottom face to hold the cartridge. In such a holding way, in a cartridge having a shape such as a simple rectangular parallelepiped, a portion of the cartridge to be held is unclear in an attaching/detaching operation. As described above, however, any one can recognize from the projection portion 2 provided on the cartridge upper face front end portion and the corner portion 4 provided on the front face middle portion thereof which correspond to both ends of the holding portion 5, that the ink cartridge 1 of the embodiment can be held by putting fingers on the two portions thereof, and the cartridge has a shape assisting attaching/detaching operation visually. For example, as is also apparent from FIG. 3C or FIG. 2, since the recess portion (notch portion 3) is provided on the cartridge front face, the holding portion 5 appears to stick out forward, which will allow the user to easily recognize that he/she may hold the cartridge at the both ends of the holding portion 5, namely the projection portion 2 and the corner portion 4.

Since the ink cartridge 1 in the embodiment has the notch portion 3 provided on the cartridge front face and the corner portion 4 which is the second finger putting portion provided thereat, the user can easily realize that the fingers are to be inserted into the notch portion 3 to hold the cartridge. Thus, the cartridge 1 has a shape that allows the user to recognize the holding way of the cartridge visually.

Provision of the notch portion 3 on the cartridge front face facilitates a cartridge attaching/detaching operation in a state of plural thin type cartridges arranged side by side.

That is, as shown in FIG. 4, when the user puts the forefinger on the corner portion 4 in a horizontally extended state thereof, the finger can not stay within a range of thickness of the cartridge to project from both sides of the cartridge. In this embodiment, however, as shown in FIG. 2, the notch portions 3 of a plurality of cartridges are positioned side by side in a state that the respective cartridges are mounted to the mounting portion 105. Therefore, when the forefinger of the user extends horizontally, it can enter in the notch portions 3, so that the user can put the finger on the corner portion 4 provided on the notch portion of a target cartridge in such a state. Since hands and fingers of a human are dexterous, the user can easily put the finger on the corner portion 4 of a target cartridge to be detached even in a state that (notch portions 3) of a plurality of cartridges 1 are arranged side by side. Regarding the projection portion 2 which is the upper side finger putting portion, since it is sufficient to put the thumb of the user on the projection portion 2 at the cartridge upper face front end from the top (with the thickness part of the thumb directed downwardly), the user can put the thumb on (the projection portion 2 of) a target cartridge easily even if the cartridge is of a thin type. The user can attach the cartridge by inserting a depth side of the cartridge into a slot 115 (FIG. 8) described later to a certain extent in a state that the user nips the holding portion 5 between the thumb and the forefinger, then releasing the fingers from the holding portion 5 to push in the front face of the cartridge.

Even when the user puts the forefinger on the projection portion 2 and puts the thumb on the corner portion 4 (when the holding way is reversed), since it is easy for the user to put the forefinger on the projection portion 2, and even if the user's thumb projects from the cartridge when the thumb is put on the corner portion 4, a projected portion of the thumb can be avoided into the notch portion 3 of an adjacent cartridge, it is easy to hold the cartridge and demounting and mounting of the cartridge can be conducted easily.

Thus, in the ink cartridge 1 of the embodiment, since the notch portion 3 is provided on the cartridge front face, handling of a thin type cartridge is improved and attaching/detaching thereof to the mounting portion is facilitated.

Figure 5:
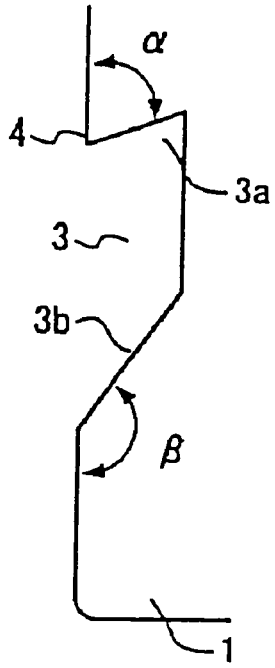
FIG. 5 is a partial enlarged view of the ink cartridge shown in FIGS. 3A to 3D in detail.

The corner portion 4 provided at the upper end portion of the notch portion 3 is formed to have an acute angle in this embodiment. Thus, a space 3*a* (FIG. 5) is formed inside the corner portion 4, so that a reception of a finger is improved and slippage of the finger is prevented. Therefore, pulling-up of the cartridge obliquely upward at a taking-out time of the cartridge is facilitated.

A lower end portion of the notch portion 3 is formed to have an obtuse angle β shown in the drawing. Therefore, insertion of a finger into the notch portion 3 is facilitated. Simultaneously, an oblique side portion 3*b* formed by the obtuse angle β serves as an introducing portion that guides the finger to the notch portion 3 visually.

Figure 6:
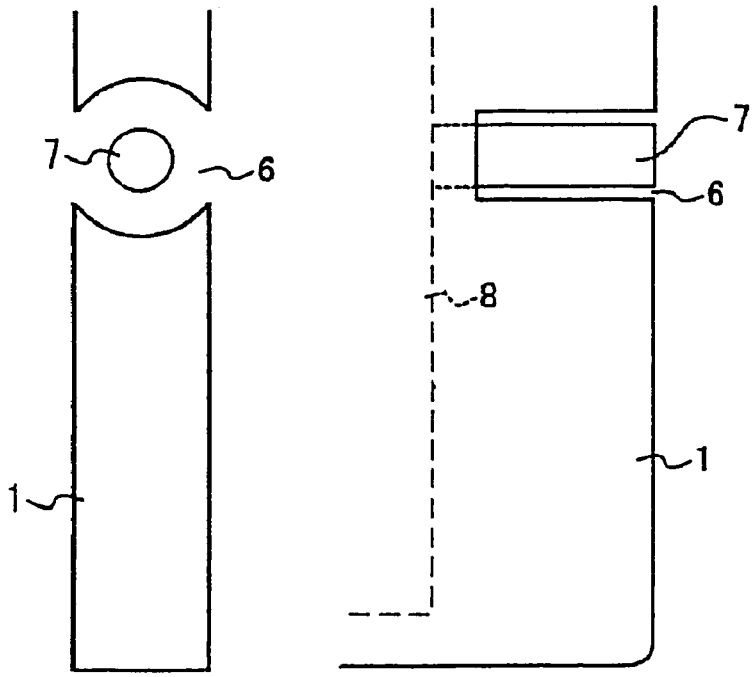
FIG. 6 is a partial detailed view of an ink supplying tube of the ink cartridge.

As shown in FIG. 6, a notch portion 6 is provided on a back face portion of the ink cartridge 1. An ink supplying tube 7 connected to an ink bag 8 housed in the cartridge is provided to be positioned inside the notch portion 6. A rubber is fitted into the ink supplying tube 7, and an ink supplying needle 110 (FIG. 7) provided in the printer main body projectingly penetrates the ink supplying tube 7 so that a distal end of the needle advances into the ink bag 8, which allows supplying of ink. When the ink supplying needle 110 is drawn out (the cartridge is detached), the rubber in the ink supplying tube 7 closes a hole formed by the needle, which prevents ink from leaking.

As shown with a rear view on the left side in FIG. 6, the above notch portion 6 is formed in a substantially circular section opened (notched) at both side faces of the cartridge. The ink supplying tube 7 with a cylindrical section is provided concentrically with the notch portion 6.

Figure 7:
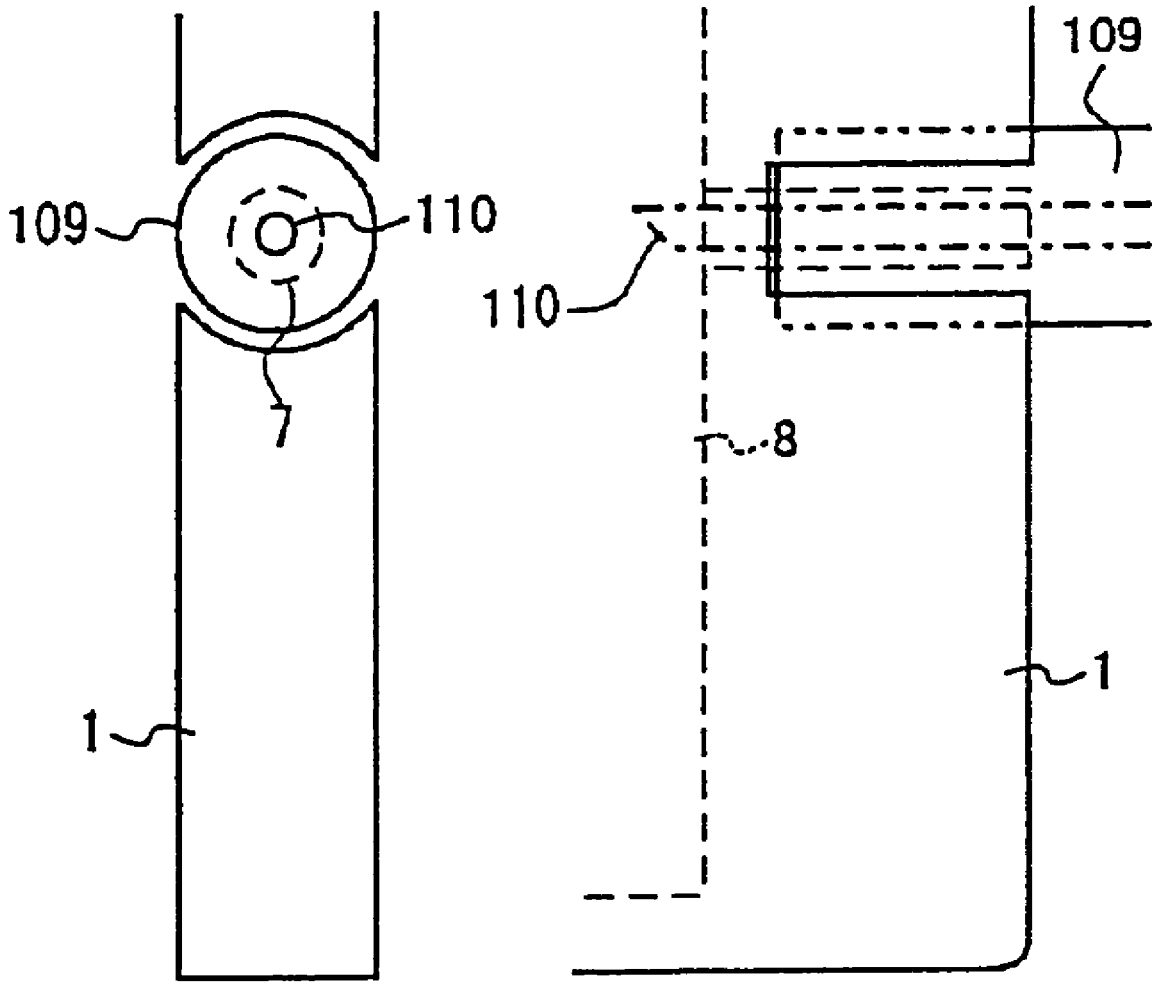
FIG. 7 is a partial detailed view of a state that an ink supplying needle 110 of a printer main unit is inserted into the ink supplying tube.

On the other hand, as shown in FIG. 7, the ink supplying needle 110 whose periphery is protected by a protective pipe 109 is provided on the main unit of the printer 100. Regarding the ink supplying needle 110, four ink supplying needles are provided so as to correspond to four color cartridges. The length of the protective pipe 109 is shorter than that of the ink supplying needle 110, and the ink supplying needle 110 is disposed in the depth of the cartridge mounting portion 105 in a state projecting from a distal end of the protective pipe 109. When the ink cartridge 1 is completely mounted to the set member 108 (FIG. 2) of the cartridge mounting portion 105, as shown in FIG. 7, the ink supplying needle 110 penetrates the ink supplying tube 7 so that a needle distal end advances into the ink bag 8. Ink in the cartridge (in the ink bag 8) is supplied to the printing head during printing.

In order to allow the ink supplying needle 110 protected by the protective pipe 109 to be inserted into the ink supplying tube 7, the protective pipe 109 must be able to advance into the cartridge up to a predetermined position without abutting on the case of the cartridge. However, when a space that allows reception of the entire protective pipe 109 is provided within a cartridge section (the thickness of the cartridge), the thickness of the cartridge increases. In the cartridge 1 of the embodiment, however, since the cartridge case is notched at both the left and right sides thereof, as shown on a rear view on the left side in FIG. 6, even if the thickness of the cartridge is reduced (thinned), the cartridge can receive the protective pipe 109. Therefore, as shown in FIG. 7, the protective pipe 109 enters into the cartridge until the distal end thereof abuts on the depth side end face of the notch portion 6 of the cartridge. At that time, the ink supplying needle 110 penetrates the ink supplying tube 7 to advance into the ink bag 8.

As shown in FIGS. 3A and 3B, the cartridge 1 of the embodiment is provided on an upper face and a lower face thereof with guide members 9 and 10. The guide members 9 and 10 serve as a guide when the ink cartridge 1 is set to the set member 108 (FIG. 2) of the mounting portion. In order for the ink supplying needle 110 to enter in the ink supplying tube 7 accurately, it is necessary to conduct accurate positioning when the cartridge is set to the set member 108. Members for conducting positioning of the cartridge are the guide members 9 and 10.

Figure 8:
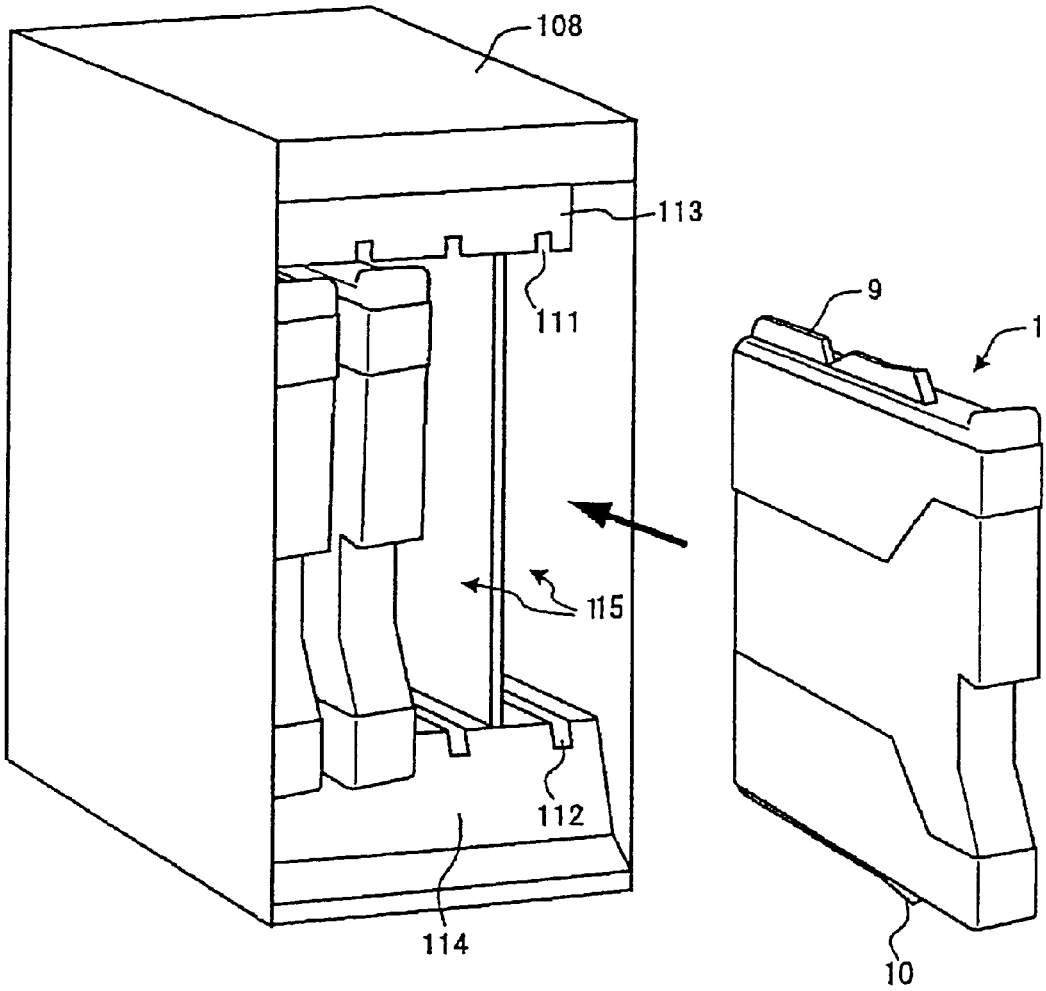
FIG. 8 is a perspective view of a constitution of the ink cartridge mounting portion of the printer main unit.

That is, as shown in FIG. 8, holding members 113 and 114 of the set member 108 are provided with slits 111 and 112 in which the guide members 9 and 10 enter. When the cartridge 1 is set to the mounting slot 115, the upper guide member 9 of the cartridge enters in the upper slit 111 and the lower guide member 10 thereof enters in the lower slit 112, so that the cartridge is positioned in a vertical direction and in left and right directions.

Figure 9:
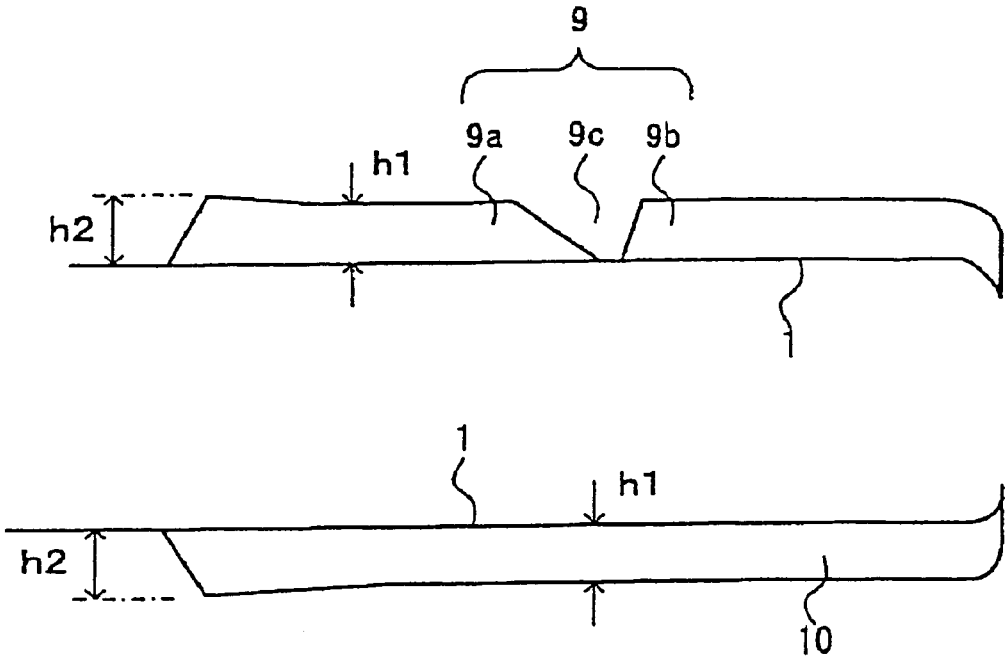
FIG. 9 is an enlarged view of a guide member provided on the ink cartridge.

As shown in FIG. 9 in an enlarged manner, the upper and lower guide members 9 and 10 are respectively constituted such that heights h2 of the respective front end portions thereof are higher than heights h1 of the remaining portions other than the front end portions. Therefore, when the upper and lower guide members 9 and 10 enter into the upper and lower slits 111 and 112, the guide members 9 and 10 smoothly enter in the slits before the front end portions reach the slits, and the cartridge 1 is securely held at the front end portions (the heights h2) of the guide members by the holding members 113 and 114, so that accurate positioning is performed in a vertical direction. Positioning of the cartridge 1 in the left and right directions (in a widthwise direction) is performed by holding the guide members 9 and 10 within the widths of the slits 111 and 112. Further, the upper guide member 9 is constituted of a front side member 9*a*, a rear side member 9*b*, and a recess 9*c* positioned therebetween, and the upper slit 111 is formed at a predetermined portion with a small projection (not shown). The small projection is fitted into the recess 9*c* of the guide member so that positioning of the cartridge 1 in front and rear directions (in a depth direction of the apparatus) can be performed.

Since the ink cartridge 1 is positioned accurately and mounted at the predetermined set position of the set member 108, the ink supplying needle 110 is inserted into the ink supplying tube 7 so that ink in the cartridge is supplied to the main unit.

Figure 10:
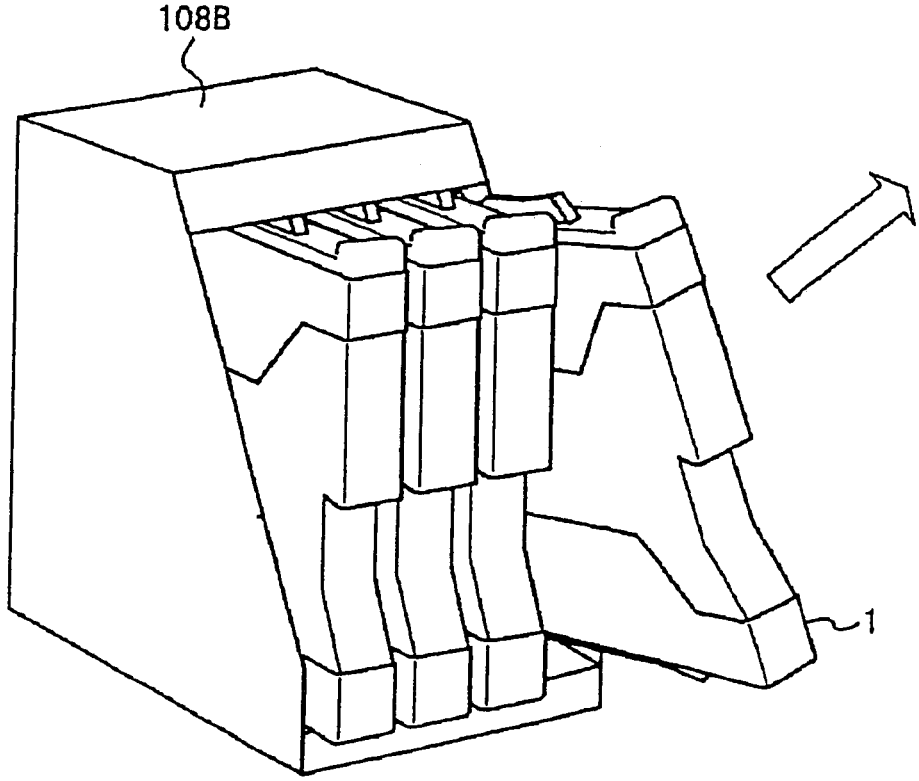
FIG. 10 is a perspective view of another example of a set member attached to the ink cartridge.

FIG. 10 is a perspective view of another example of the set member attached to the ink cartridge 1. A set member 108B shown in the drawing is also provided with holding members having slits similar to the holding members 113 and 114 shown in FIG. 8, but the holding members are not shown. The set member 108B has an upper face portion retreated to an apparatus depth side and is formed in such a shape as a rectangular parallelepiped with a front upper corner portion cut. A depth size of an upper side holding member (not shown) is shortened corresponding to such a shape.

In the set member 108B of the example, when the mounted ink cartridge 1 is demounted therefrom, the cartridge 1 can be pulled out in an obliquely upward direction by sliding the cartridge 1 forward to a certain extent (such a position where the front side member 9*a* (see FIG. 9) of the upper guide member is released from the slit). Further, the cartridge can be mounted by first inserting the cartridge 1 in the slot obliquely downwardly and then pushing the cartridge 1 toward the depth side in a horizontal direction. Thus, in the set member 108B of the example, the degree of freedom in an attaching/detaching direction of the ink cartridge 1 is increased, so that operability can be improved.

Figure 11:
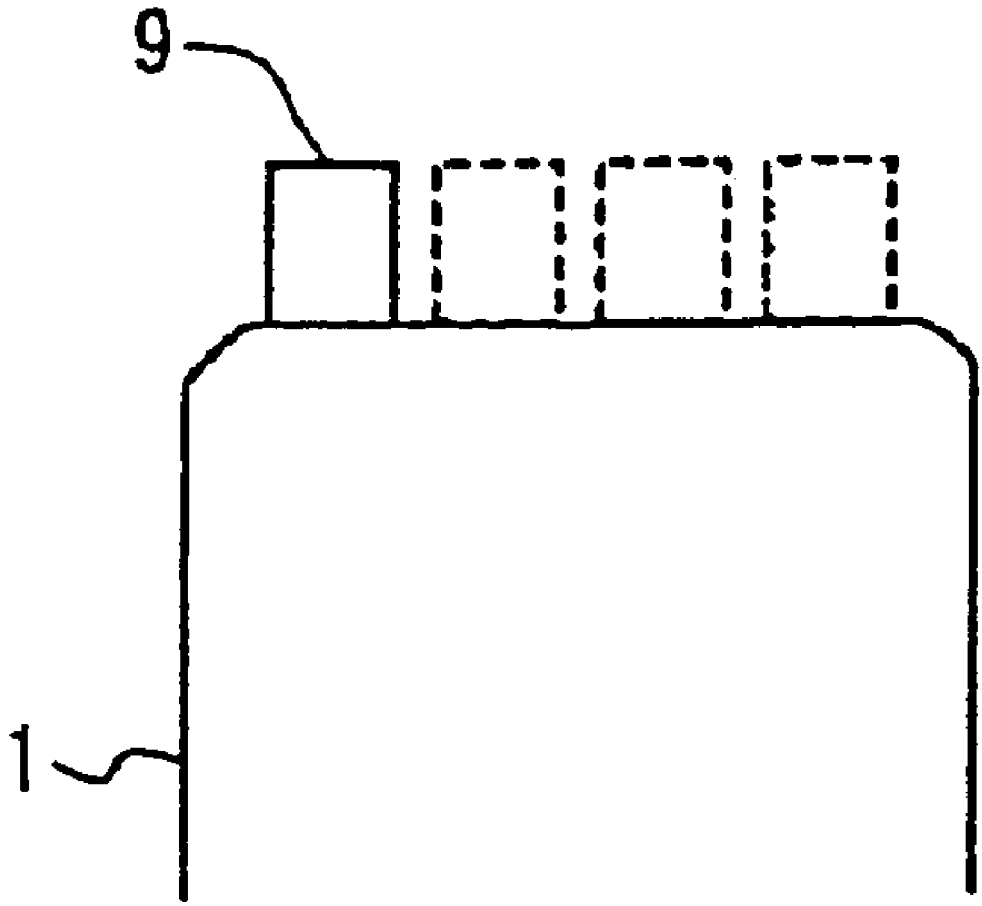
FIG. 11 is a partial enlarged view of an example of the guide member provided so as to correspond to ink color to be accommodated.

FIG. 11 is a partial enlarged view of an example of the guide member provided so as to correspond to ink color to be accommodated.

As shown in the drawing, the upper guide member 9 provided on the cartridge upper face is formed at a different position as shown with a solid line or dotted lines corresponding to the color of ink stored in the cartridge. Obviously, the slit 111 (see FIG. 8) in which the guide member 9 is inserted is also formed at a different position corresponding to the position of the upper guide member 9. Thus, for example, respective cartridges for black, cyan, magenta, and yellow can be set in only proper slots 115 (see FIG. 8) corresponding to the respective colors, so that mounting of an erroneous color cartridge is prevented.

Each color cartridge can be set to a proper position by changing the position of the lower guide member 10 instead of the upper guide member 9. Alternatively, each color cartridge may be set to a proper position according to a combination of both positions of the upper guide member 9 and the lower guide member 10.

The present invention has been explained with reference to the examples in the drawings, however, it is not limited thereto. For example, the projection portion 2 which is the first finger putting portion is formed in a semi-circular sectional shape in this example, as shown in FIG. 3B, but it may be formed in an angular shape with corners. Alternatively, the projection portion 2 may be formed in a slope shape whose height gradually lowers toward the cartridge depth side. Further, the projection portion 2 is not limited to the front end portion of the cartridge upper face, as shown in the drawing, but it may be provided to be positioned slightly at the depth side. Further, the corner portion 4 which is the second finger putting portion may be formed in a rounded shape. Furthermore, the notch portion 3 at the cartridge front face is not limited to an angular shape as this example, but it may be formed in a notch portion with a rounded (without corners) shape.

The guide member provided for positioning a cartridge is not limited to a flat plate shape such as that shown in FIGS. 3A to 3D, but it may be formed in a box shape with a further thickness. The shape or the material of the ink supplying tube on the cartridge side, or shapes and constitutions of the ink supplying needle and the protective member on the apparatus main unit side may be modified appropriately.

Although the example in the drawing is constituted such that the ink cartridge 1 is basically attached/detached in a horizontal direction (the ink cartridge is moved in a horizontal direction in a detaching initial stage), attaching/detaching may be performed in a vertical direction or in an oblique direction. Even in such case, attaching/detaching operation is facilitated according to the cartridge of the present invention. The ink supplying tube 7 and the notch portion 6 provided around the tube, the guide members 9 and 10, or the like may be provided at positions suitable for an attaching/detaching direction.

The present embodiment describes the ink cartridge of the type in which the ink cartridge is mounted on the apparatus main unit independently of the printing head (and carriage), but an ink cartridge of a type in which it is mounted on an apparatus main unit together with a head is also applicable with the present invention. Further, it is possible to use the ink cartridge together with a pop-up mechanism on the main unit side (a mechanism for moving the cartridge to a detaching position).

As explained above, according to the ink cartridge of the invention, since the holding portion formed over two faces of the cartridge adjacent to each other is provided, even if the cartridge is of a thin type, the cartridge can be held securely, so that attaching/detaching to the printer main body can be performed easily and securely.

According to the ink cartridge of the invention, since the holding portion is formed to be held from a vertical direction, a holding style corresponding to a thin type cartridge is possible. Attaching/detaching operation is facilitated regardless of an attaching/detaching direction.

According to the ink cartridge of the invention, since the two faces of the cartridge adjacent to each other are an upper face and a front face of the cartridge, attaching/detaching can be conducted easily owing to the holding portion extending over the upper face and the front face.

According to the ink cartridge of the invention, since one end of the holding portion is the projection portion provided on an upper face of the cartridge, the user's finger can be put easily, so that the cartridge can be held easily and securely.

According to the ink cartridge of the invention, since the projection portion is provided on the front end portion of the cartridge upper face, the cartridge in an attached state can be held easily. Even during attaching/detaching operation of the cartridge, the finger is hard to come in contact with another cartridge or the printer main unit, and attaching/detaching operation can be facilitated.

According to the ink cartridge of the invention, since one end of the holding portion is the corner portion of the recess portion provided on the front face of the cartridge, a portion of the cartridge on which the finger should be put can be recognized easily, and the cartridge can be held easily.

According to the ink cartridge of the invention, since the corner portion of the recess portion is formed to have an acute angle, the user's finger is hard to slip thereon, so that the cartridge can be held securely.

According to the ink cartridge of the invention, since the corner portion of the recess portion is positioned in a midway, in a vertical direction, of the front face of the cartridge, even if the cartridge has a size large in a vertical direction, the cartridge can be held easily. Accordingly, the cartridge can be held easily and securely even with a small hand.

According to the ink cartridge of the invention, since the recess portion is formed over the entire width of the cartridge and it is opened at both the end portions, the user can put the finger on the recess portion with the finger projecting from the recess portion, which facilitates putting the finger thereon. Recess portions of cartridges arranged side by side can be used for respective cartridges, so that taking-out of a thin type cartridge can be facilitated.

According to the ink cartridge of the invention, since the angle formed by the lower end portion of the recess portion and the cartridge front face is an obtuse angle, the introducing portion of the finger to the recess portion can be formed, and a finger putting operation of the user can be facilitated.

According to the ink cartridge of the invention, since the holding portion has a flat portion which can be pressed in a cartridge mounting direction, the cartridge can be attached securely and easily by pushing the holding portion.

According to the ink cartridge of the invention, since holding style of the holding portion can be changed according to a height at a time of cartridge mounting, attaching/detaching of the cartridge can be conducted easily regardless of an installation place of a printer.

According to the ink cartridge of the invention, since the guide member is provided for guidance during cartridge mounting, a cartridge mounting operation to the printer main unit can be facilitated.

According to the ink cartridge of the invention, since positioning at a time of cartridge mounting is performed by the guide member, ink can be supplied securely.

According to the ink cartridge of the invention, since the guide member has the positioning portion applied for positioning in a vertical direction, positioning of the ink cartridge in the vertical direction can be conducted securely.

According to the ink cartridge of the invention, since the guide member has the positioning portion applied for positioning in front and rear directions, positioning of the ink cartridge in the front and rear directions can be conducted securely.

According to the ink cartridge of the invention, since the guide members are provided at different positions corresponding to colors of inks to be accommodated, attaching of an erroneous color ink cartridge is prevented.

According to the ink cartridge of the invention, since the ink supplying tube is provided at the cartridge rear face portion, the space is provided around the ink supplying tube, and the space is opened to the outside at the both sides, in the widthwise direction, of the cartridge, the protective member that protects the ink supplying needle in the printer main unit can be escaped even in a thin type cartridge.

According to the ink cartridge of the invention, since the recess portion is provided at the cartridge front face, the finger putting portion can be provided at the cartridge front face, so that the ink cartridge can be held utilizing the finger putting portion.

According to the ink cartridge of the invention, since one corner portion of the recess portion is the finger putting portion on which a finger is put during cartridge attaching/detaching, a portion of the ink cartridge on which the finger should be put can be recognized easily, so that the user can grasps the cartridge easily.

According to the ink cartridge of the invention, since the finger putting portion is formed to have an acute angle, the finger of the user is hard to slip thereon, and the cartridge can be held securely.

According to the ink cartridge of the invention, since the recess portion is positioned in a midway, in a vertical direction, of the front face of the cartridge, even if the cartridge has a size large in a vertical direction, the cartridge can be held easily. Accordingly, even if the user has a small hand, the cartridge can be held easily and securely.

According to the ink cartridge of the invention, since the recess portion is formed over an entire width of the cartridge and it is opened at both the end portions, the user can put the finger on the recess portion with the finger projecting from the recess portion, which facilitates putting of the finger thereon. Recess portions of cartridges arranged side by side can be used for respective cartridges, so that taking-out of a thin type cartridge can be facilitated.

According to the ink cartridge of the invention, since the angle formed by the lower end of the recess portion and the cartridge front face is an obtuse angle, the introducing portion of the finger to the recess portion can be formed, and a finger putting operation of the user can be facilitated.

According to the present invention, an ink jet printer which allows easy and secure attaching/detaching of an ink cartridge even if the cartridge is of a thin type, can be provided.

According to the ink jet printer of the invention, even in a color printer where a plurality of ink cartridges are mounted outside a sheet threading width independently of a printing head, a mounting width for the ink cartridges can be suppressed considerably.

According to the ink jet printer of the invention, even in a color printer where a plurality of ink cartridges are mounted on a carriage together with a printing head, a thin type ink cartridge can be attached/detached easily and securely.

According to the ink jet printer of the invention, even when an attaching/detaching direction of an ink cartridge is horizontal, a thin type ink cartridge can be attached/detached easily and securely.

According to the ink jet printer of the invention, even when an attaching/detaching direction of an ink cartridge is vertical, a thin type ink cartridge can be attached/detached easily and securely.

According to the ink jet printer of the invention, since the holding member that holds the ink cartridge is positioned such that the upper side member is retreated nearer to the apparatus depth side as compared with the lower side member, the degree of freedom in the cartridge attaching/detaching direction is increased so that an attaching/detaching operation is facilitated.

INDUSTRIAL APPLICABILITY

As described above, the ink cartridge and the ink jet printer according to the present invention are useful in a printer where an image is formed by ejecting ink dots on a recording sheet or the like or a structure for cartridges for multiple color inks in the printer, and they are especially suitable for a cartridge structure, an ink jet printer, various printers, and a system applied therewith.

The invention claimed is:

1. An ink cartridge that can be detachably attached to an ink jet printer, comprising:

a holding portion formed over two adjacent faces of the ink cartridge, one end of the holding portion being a corner portion of a recess portion provided on a front face of the ink cartridge, the corner portion of the recess portion having an acute angle, and the ink cartridge being attached or detached in a horizontal direction.

2. The ink cartridge according to claim 1, wherein the holding portion has a structure held from a vertical direction.

3. The ink cartridge according to claim 1, wherein the two adjacent faces of the ink cartridge are an upper face and a front face of the ink cartridge.

4. The ink cartridge according to claim 1, wherein one end of the holding portion is a projection portion provided on an upper face of the ink cartridge.

5. The ink cartridge according to claim 4, wherein the projection portion is provided at a front end portion of the upper face of the ink cartridge.

6. The ink cartridge according to claim 1, wherein the corner portion of the recess portion is positioned in a midway, in a vertical direction, of the front face of the ink cartridge.

7. The ink cartridge according to claim 1, wherein the recess portion is formed over an entire width of the ink cartridge and is opened at both end portions.

8. The ink cartridge according to claim 1, wherein an angle formed by a lower end portion of the recess portion and the front face of the ink cartridge is an obtuse angle.

9. The ink cartridge according to claim 1, wherein the holding portion has a flat portion that allows pressing in a cartridge mounting direction.

10. The ink cartridge according to claim 1, wherein a holding style of the holding portion can be changed according to a height at a time of cartridge mounting.

11. The ink cartridge according to claim 1, further comprising:

a guide member that guides the ink cartridge during cartridge mounting.

12. The ink cartridge according to claim 11, wherein the guide member allows positioning of the ink cartridge in the ink jet printer.

13. The ink cartridge according to claim 12, wherein the guide member allows positioning of the ink cartridge in the ink jet printer in a vertical direction.

14. The ink cartridge according to claim 12, wherein the guide member allows positioning of the ink cartridge in the ink jet printer in a front direction and a rear direction.

15. The ink cartridge according to claim 11, wherein the guide member is provided at a different position corresponding to a color of ink in the ink cartridge.

16. The ink cartridge according to claim 1, further comprising:

an ink supplying tube that is provided at a rear face portion of the ink cartridge and encircled by a space that is opened at both sides, in a widthwise direction, of the ink cartridge.

17. An ink cartridge that is detachably attached to an ink jet printer, comprising:

a recess portion, for a user to put a finger, that is provided at a front face of the ink cartridge, the recess portion including one corner portion on which the finger of the user is put, the corner portion having an acute angle, and the ink cartridge being attached or detached in a horizontal direction.

18. The ink cartridge according to claim 17, wherein the recess portion is positioned in a midway, in a vertical direction, of the front face of the ink cartridge.

19. The ink cartridge according to claim 17, wherein the recess portion is formed over an entire width of the ink cartridge and is opened at both end portions.

20. The ink cartridge according to claim 17, wherein an angle formed by a lower end portion of the recess portion and the front face of the ink cartridge is an obtuse angle.

21. An ink jet printer, comprising:

an ink cartridge that is detachably attached to the ink jet printer and includes a holding portion formed over two adjacent faces of the ink cartridge, one end of the holding portion being a corner portion of a recess portion provided on a front face of the ink cartridge, the corner portion of the recess portion having an acute angle, and the ink cartridge being attached or detached in a horizontal direction.

22. An ink jet printer, comprising:

an ink cartridge that is detachably attached to the ink jet printer and includes a recess portion for a user to put a finger, the recess portion provided at a front face of the ink cartridge, the recess portion includes one corner portion on which the finger of the user is put, the corner portion having an acute angle, and the ink cartridge being attached or detached in a horizontal direction.

* * * * *